US005285803A

United States Patent [19]

Baldwin et al.

[11] Patent Number: 5,285,803

[45] Date of Patent: Feb. 15, 1994

[54] EMERGENCY UMBRELLA

[75] Inventors: Blair F. Baldwin, New York, N.Y.; Russell G. Dobrowski, Clinton; Arthur L. Arledge, Basking Ridge, both of N.J.

[73] Assignee: Bexel Corporation, New York, N.Y.

[21] Appl. No.: 33,495

[22] Filed: Mar. 18, 1993

[51] Int. Cl.[5] ..... A45B 13/00

[52] U.S. Cl. ..... 135/19.5; 135/20.3; 135/25.1

[58] Field of Search ..... 135/15.1, 16, 20.3, 135/20.1, 20.2, 25.1, 25.41, 25.4

[56] References Cited

U.S. PATENT DOCUMENTS

| | | | |
|---|---|---|---|
| 2,183,833 | 12/1939 | Farhar | 135/20.3 |
| 2,485,118 | 10/1949 | Simpson | 135/20.3 X |
| 2,485,475 | 10/1949 | Brenneman | 135/20.3 X |
| 4,084,600 | 4/1978 | dePolo | 135/15.1 |
| 4,424,824 | 1/1984 | Becher | 135/20.3 |
| 4,821,756 | 4/1989 | England | 135/19.5 |
| 5,141,010 | 8/1992 | Muller et al. | 135/20.3 |

FOREIGN PATENT DOCUMENTS

| | | | |
|---|---|---|---|
| 2441817 | 3/1976 | Fed. Rep. of Germany | 135/20.3 |

*Primary Examiner*—Carl D. Friedman
*Assistant Examiner*—Lan C. Mai
*Attorney, Agent, or Firm*—Burgess, Ryan & Wayne

[57] ABSTRACT

An umbrella includes a hollow tubular handle extending in an axial direction, the handle having an upper edge and a lower portion; an elongated rod having an upper end and a lower end, the elongated rod movable in the axial direction within the hollow tubular handle; a plurality of struts pivotally mounted to the upper end of the elongated rod for movement in a range between a storage position substantially parallel to the axial direction and adjacent to the elongated rod, and an open position substantially perpendicular to the axial direction; a web of flexible, water-resistant material connected to the struts; and a locking mechanism connected to a lower end of the elongated rod for engaging with a lower portion of the tubular handle to releasably lock the struts in either the open position in which the struts rest on the upper edge of the tubular handle, and the closed position in which the struts are positioned within the tubular handle, the locking mechanism including two diametrically opposite spring fingers mounted to the lower end of the elongated rod, each spring finger having a first step for engaging with the lower portion of the tubular handle to releasably lock the struts in the open position, and a second step for engaging with the lower portion of the tubular handle to releasably lock the struts in the closed position, the first outer step being positioned below and radially outward of the second outer step on each spring finger.

21 Claims, 8 Drawing Sheets

EMERGENCY UMBRELLA

BACKGROUND OF THE INVENTION

The present invention relates generally to umbrellas, and more particularly, is directed to an emergency umbrella in which the handle also functions as a carrying case.

Because of unpredictability in the weather, it would be desirable to always have an umbrella ready at hand in case of an emergency. However, the size and bulkiness of conventional umbrellas does not make this feasible. Although there are presently on the market conventional umbrellas sold, for example, under the trademark "Totes" which are compact and fit within a briefcase, such umbrellas are rather complex in construction, use costly raw materials and are therefore expensive and relatively heavy.

Disposable umbrellas of the type in which the handle also functions as a carrying case are disclosed, for example, in U.S. Pat. Nos. 4,624,275; 4,842,003; and 4,966,179, all having at least one common inventor herewith, and the entire disclosures of which are incorporated herein by reference.

With the disposable umbrella of U.S. Pat. No. 4,624,275, the canopy and struts must be physically removed through one end of the tubular handle and then attached at the opposite end thereof. This may be rather inconvenient and troublesome.

With U.S. Pat. Nos. 4,624,275 and 4,842,003, the struts are stored in the handle in an inverted configuration. Accordingly, it is difficult to provide a pre-bowed canopy for use therewith.

U.S. Pat. No. 2,700,390 discloses a disposable umbrella in which the handle is detachable from the main portion of the umbrella and serves as a carrying case therefor. With this umbrella, the struts or ribs are normally pivoted in a direction opposite that from a normally closing umbrella, that is, in a direction inverted from a conventional umbrella. In order to prevent the struts from inverting during normal use, it is necessary with such an umbrella to utilize cords or similar type elements to tie down the struts. Further, when the umbrella is contained within the handle, the struts and canopy are inverted first and then inserted into the handle, with the hub being used as a cap on top of the open end of the handle. In operation, the entire canopy, struts and cap must first be removed from the handle, then inverted so that the cap is used as a plug on top of the handle. The canopy and struts must then be pushed down to their operable position, with the struts then being tied down by cords.

U.S. Pat. No. 3,186,421 discloses a compact umbrella in which an insert block is slidably movable within a handle between a first stored position and a second open position, with the struts pivotally connected to the insert block. When the insert block is moved to the open position, the struts are opened by gravity and position themselves within respective receiving slots in the handle. It is the receiving slots that maintain the struts in their open position.

U.S. Pat. No. 4,084,600 discloses an umbrella in which the struts or ribs are pivotally secured to a hub which slides within the handle. In this patent, the struts or ribs are pivotally attached to the hub for movement to a completely inverted position when it is carried within the handle. However, a relatively complicated arrangement of a biased locking plate which biases the inner ends of the struts to maintain them in their open position is provided. U.S. Pat. No. 2,439,752 also discloses an umbrella in which the struts and canopy are insertable within a handle. The struts and canopy are locked in place at the upper end of the handle by a coupling or fastening pin which passes through openings an opposite sides of the upper part of the tubular handle. However, to close the umbrella, the ribs are not pivotable downwardly into the handle, but only laterally in the plane of the umbrella in its open position and then removed from the handle and inserted therein for storage.

U.S. Pat. No. 4,456,023 discloses an umbrella which is storable within its carrying handle. However, there is no disclosure as to how the umbrella is opened and from the disclosure in the patent, it appears that such an umbrella has a relatively complicated linkage assembly similar to that of compact umbrellas sold under the trademark "Totes".

U.S. Pat. No. 892,813 discloses a folding umbrella in which the struts fit within the handle during storage, and the handle functions to hold the umbrella when the umbrella is in its open configuration. However, the shaft to which the struts are mounted functions as an extension of the umbrella in its opened configuration, and accordingly, the struts are provided with a pivot point midway therealong for storing the struts in the handle.

U.S. Pat. No. 2,747,592 discloses a collapsible umbrella which is also relatively complicated in construction and use.

French Pat. No. 1,429,394 discloses an umbrella having a ball which is slidable within a handle between the upper and lower positions. A canopy is secured by angled cords to the ball and is normally held with the ball in the handle. In use, when the ball is pulled out by an auxiliary cord, the canopy is forced out of the handle and is held in its open position by the angled cords secured to the central ball. In effect, the French patent is similar to the aforementioned U.S. Pat. No. 2,700,390 which requires cords to tie down the struts or canopy to prevent the umbrella from inverting. Although U.S. Pat. No. 2,994,333 discloses a peripheral cord, this cord is used for securing the canopy, and separate tie down cords are required for imparting a bow shape to the umbrella.

U.S. Pat. No. 3,709,238 discloses an umbrella in which the hub which contains the umbrella struts connected thereto is slidable within the handle. During folding of the umbrella, the hub slides inwardly into the handle, and the struts and canopy fold upwardly and follow the hub into the handle. An inwardly extending annular shoulder is provided for preventing escape of the hub from the handle. Radially extending flexible stays or struts support the canopy material in the extended open position. However, to maintain the canopy in its open position, extending cord members are connected between the struts and the hub and are, therefore, similar to the aforementioned U.S. Pat. No. 2,700,390 and French Pat. No. 1,429,394.

U.S. Pat. No. 284,495 discloses an umbrella having a canopy provided with a cord enclosed in the canopy seams, and a strut or rib structure incorporating a slit tubular recess into which the cord is fit to lock the canopy in place. Such recessed strut is inherently of uniform cross section, determined by the size and shape of the, cord.

U.S. Pat. No. 369,374 discloses a cane umbrella. As described therein, struts are tapered so that the peripheral end will have considerably more flexibility and the struts or ribs can be of solid cross-section or hollow on the underside. The struts or ribs are hingedly connected to a central hub which is locked down on top of the handle by a screw-threaded center piece. However, to store the umbrella, the center piece must be unscrewed and the hub removed, whereupon the struts are pivoted to a closed position and then inserted through the handle, followed by closure of the center piece on top of the handle. This renders the construction relatively complicated in use.

U.S. Pat. No. 3,844,301 discloses a collapsible umbrella in which the struts are fixedly held to a hub which is slidable within the handle of the umbrella. With this construction, guide tracks must be employed in the handle to deploy the struts in an arcuate configuration as they exit the handle. Because of the guide tracks that must be employed within the handle, the upper end of the handle is made with an outwardly flared configuration. Without the guide tracks in the handle, there would be no initial bending of the struts as they exit the handle. In addition, this patent discloses struts of a uniform cross section. In this regard, because of such uniform cross section, the struts must have a uniform bending throughout the length thereof. More importantly, it is necessary to..use struts of a uniform cross-section in view of the use of guide tracks in the handle. If the struts were of varying cross section, the guide tracks would be inoperative or at least would function improperly.

OBJECTS AND SUMMARY OF THE INVENTION

Accordingly, it is an object of the present invention to provide a disposable, reusable umbrella that overcomes the aforementioned problems with the prior art.

It is another object of the present invention to provide an umbrella in which the struts are held in the handle in a non-inverted position and are never moved to the inverted position thereof.

It is still another object of the present invention to provide an umbrella in which the handle functions to hold the umbrella in the open configuration thereof and to store the umbrella in the closed configuration thereof.

It is yet another object of the present invention to provide an umbrella in which the struts and canopy are locked in the open configuration and in the closed configuration within the tubular handle.

It is a further object of the present invention to provide an umbrella in which such locking is achieved by a common locking mechanism.

It is a still further object of the present invention to provide an umbrella in which centering of elongated rod and struts occurs during opening and closing of the umbrella.

It is a yet further object of the present invention to provide an umbrella in which the struts and elongated rod are prevented from turning during furling of the canopy during the closing operation.

It is another object of the present invention to provide an umbrella that is relatively lightweight, and easy and economical to manufacture and use, due to the simplified construction and the reduction and simplification of parts.

In accordance with an aspect of the present invention, an umbrella includes a hollow tubular handle extending in an axial direction, the hollow tubular handle having an upper edge and a lower portion; an elongated rod having an upper end and a lower end, the elongated rod movable in the axial direction within the hollow tubular handle; a plurality of struts pivotally mounted to the upper end of the elongated rod for movement in a range between a storage position substantially parallel to the axial direction and adjacent to the elongated rod, and an open position substantially perpendicular to the axial direction; a web of flexible, water-resistant material connected to the struts; and a locking mechanism connected to a lower end of the elongated rod for engaging with a lower portion of the tubular handle to releasably lock the struts in either the open position in which the struts are positioned substantially perpendicular to the axial direction and rest on the upper edge of the tubular handle, and the closed position in which the struts are positioned substantially parallel to the axial direction and adjacent to the elongated rod within the tubular handle.

The hollow tubular handle includes an upper portion which is outwardly flared, and the upper portion includes the upper edge.

A hub pivotally mounts the struts to the upper end of the elongated rod, and includes an annular section having a central bore for receiving the upper end of the elongated rod and a plurality of strut retaining walls extending radially outward from the annular section so as to define strut receiving slots therebetween. Pivot pins extend between adjacent strut retaining walls for pivotally connecting the struts to the hub. Preferably, the strut retaining walls have a substantially wedge shape.

A stop is provided on the elongated rod for positioning the hub thereon at a predetermined position, and a retaining cap is secured to the upper end of the elongated rod for maintaining the hub thereon. The web includes a central opening for receiving the upper end of the elongated rod, and the web is sandwiched between the hub and the retaining cap. In addition, a resilient member for biasing the struts in a radially outward direction is positioned about the elongated rod immediately below the hub.

In a preferred embodiment, the locking mechanism includes at least one spring finger mounted to the lower end of the elongated rod, each spring finger having a first releasable lock for engaging with the lower portion of the tubular handle to releasably lock the struts in the open position in which the struts are positioned substantially perpendicular to the axial direction and rest on the upper edge of the tubular handle, and a second releasable lock for engaging with the lower portion of the tubular handle to releasably lock the struts in the closed position in which the struts ar positioned substantially parallel to the axial direction and adjacent to the elongated rod within the tubular handle.

The first releasable lock of each spring finger includes a first outer step in the respective spring finger, and the second releasable lock of each the spring finger includes a second outer step in the respective spring finger. The first outer step is positioned below the second outer step on each respective spring finger and is positioned radially outward of the second outer step on each respective spring finger. Preferably, there are two spring fingers which are diametrically opposite each other for engaging opposite sides of the lower portion of the tubular handle.

In addition, the tubular handle has an upper portion containing the upper edge, the upper portion having an inner surface with at least one stop tab thereon, and ..each locking mechanism further includes at least one restraining arm, each arm cooperating with one spring finger to receive one stop tab therebetween so as to prevent rotation of the elongated rod in the tubular handle when furling the web during a closing operation of the umbrella.

In an alternative embodiment, the locking mechanism includes a substantially T-shaped slot in the tubular handle, the substantially T-shaped slot including an axial portion which extends axially along the tubular handle and a transverse portion which extends substantially perpendicular to the axial portion and is in communication with a lower end of the axial portion; and a pin connected with the lower end of the elongated rod and extending through the slot for moving the elongated rod axially within the tubular handle when the pin is engaged in the axial portion, and preventing movement of the elongated rod and releasably locking the struts in the open and closed positions when the pin is engaged within the transverse portion.

Lastly, a guide is provided for maintaining the elongated rod in a coaxial relation with the tubular handle when the elongated rod is moved in the axial direction of the tubular handle. The guide includes a star wheel having an annular section rotatably and slidably mounted on the elongated rod, and a plurality of spring arms extending radially outward from the annular section for engaging with an inner surface of the tubular handle.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
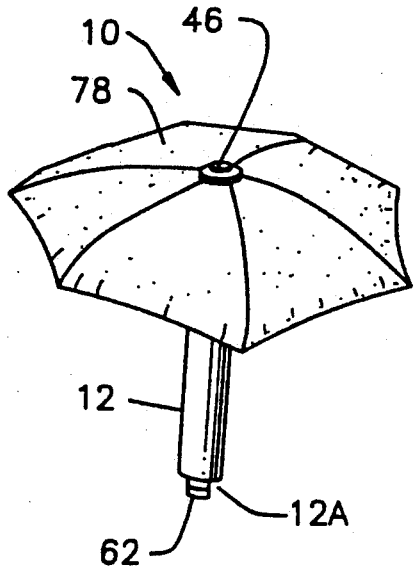
FIG. 1 is a perspective view of an umbrella according to the present invention.
Figure 2:
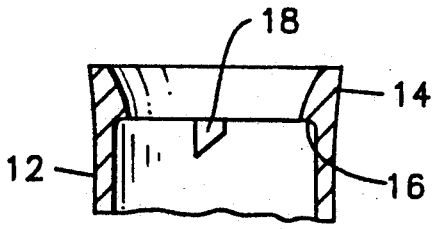
FIG. 2 is a longitudinal cross-sectional view of the upper portion of the tubular handle.

Referring to the drawings in detail, and initially to FIGS. 1 and 2 thereof, an umbrella 10 according to the present invention, includes an elongated, hollow tubular handle 12 which is open at opposite ends thereof. The upper end 14 of tubular handle 12 is outwardly flared, and has a thickness greater than the remainder of handle 12. Since the outer surface of tubular handle 12 forms a continuous smooth surface, an inner annular shoulder 16 is defined between the inner surface of upper end 14 and the inner surface of the remainder of tubular handle 12. Two diametrically opposite stop tabs 18 extend downwardly from handle 12. Preferably, the lower edges of stop tabs 18 are inclined, as shown in FIG. 2, although the stop tabs 18 can alternatively have a square shape.

Figure 3:
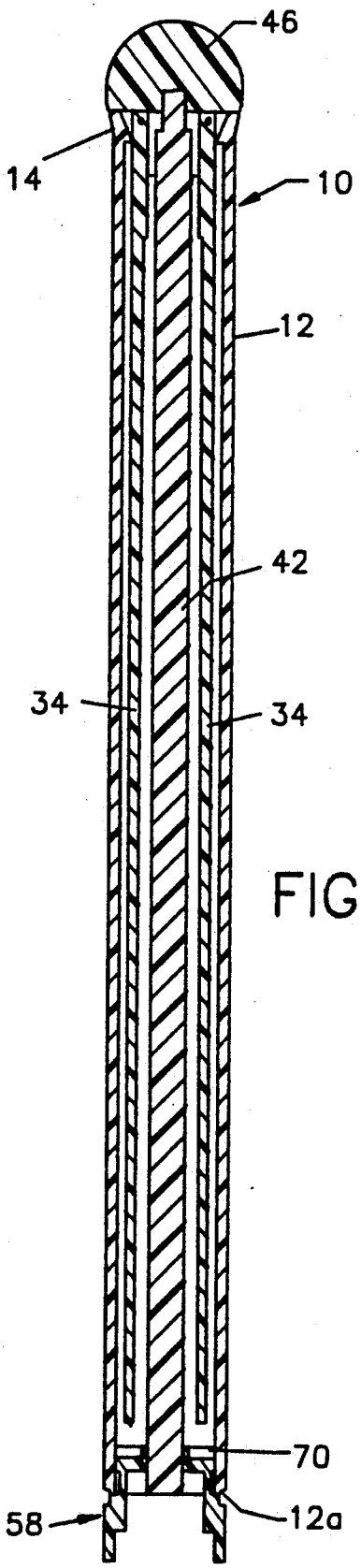
FIG. 3 is a longitudinal cross-sectional view of the umbrella of FIG. 1 in its stored position.
Figure 4:
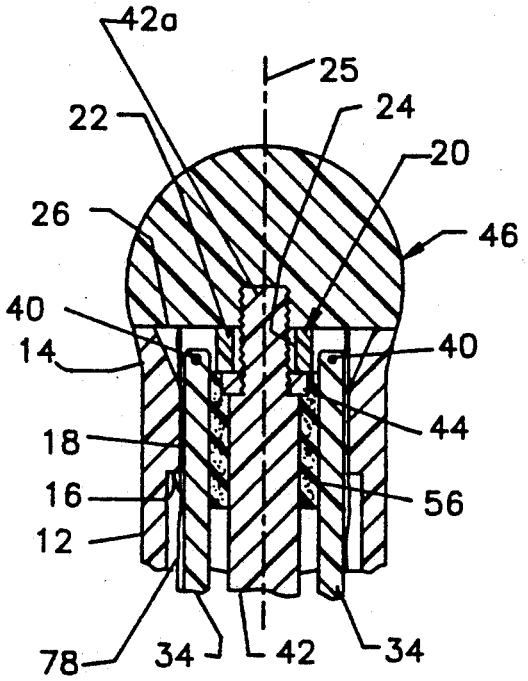
FIG. 4 is an enlarged longitudinal cross-sectional view of the upper portion of the umbrella of FIG. 3.
Figure 5:
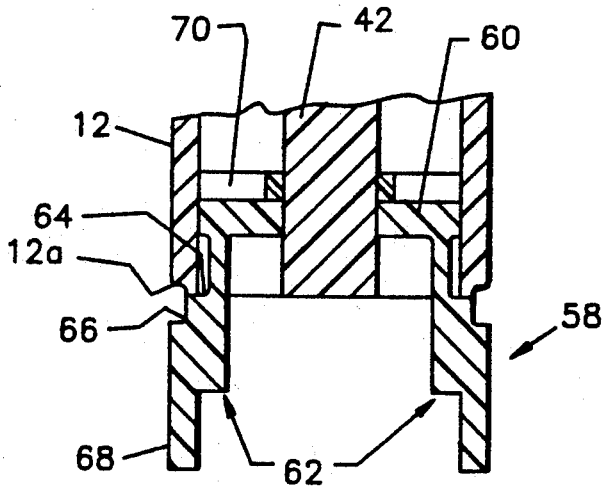
FIG. 5 is an enlarged longitudinal cross-sectional view of the lower portion of the umbrella of FIG. 3.
Figure 6:
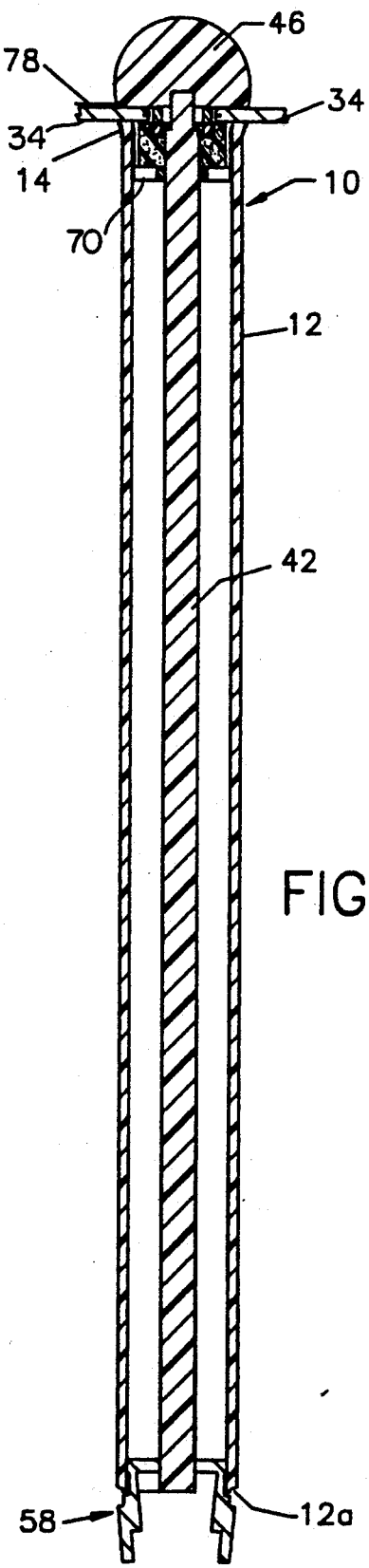
FIG. 6 is a longitudinal cross-sectional view of the umbrella of FIG. 1 in its open position.

As will be appreciated from the discussion which follows, tubular handle 12 functions as a handle for the umbrella in the open configuration of FIGS. 1 and 6-8, and as a container for the umbrella in the closed, stored position of FIGS. 3-5.

As shown in FIGS. 4, 7, 12 and 13, umbrella 10 further includes a hub 20 having an annular section 22. A central bore 24 having a central axis 25 is provided within annular section 22. Hub 20 further includes a plurality of wedge-shaped strut retainers 26 extending outwardly in the radial direction from annular section 22 and being equiangularly spaced therearound. The outer diameter of hub 20, as defined by the outer peripheries of strut retainers 26, is less than the inner diameter of tubular handle 12 so that hub 20 can freely slide therein. Opposing side walls 28 of adjacent strut retainers 26, along with the outer surface of annular section 22, define substantially rectangular-shaped slots 30 therebetween. Preferably, there are six strut retainers 26, although the present invention is not limited thereby. Each side wall 28 has a pin opening 32 therein which is in alignment with the pin opening of the opposing side wall 28 of the adjacent strut retainer 26.

As shown in FIGS. 3, 6, 15 and 16, a plurality of struts 34 are pivotally connected to hub 20. Each strut 34 is preferably made of polypropylene and has a tapered configuration, tapering from proximal end 34*a* thereof to distal or free end 34*b* thereof. The taper permits each strut 34 to bow, with the bow being greater toward the periphery. Although the distal end 34*b* of each strut 34 is shown having a disc-like end, the present invention is not so limited. To aid in operation of the umbrella, a portion 34c of each strut 34 extending a small distance from the proximal end 34a thereof has a greater depth than the remainder of each strut 34, thereby defining a shoulder 34d.

Preferably, grooves or slots 36 are provided longitudinally of each strut 34 so as to provide a channelled or cored strut. Such channelling or coring of struts 34 reduces weight and raw materials required, aids in reducing side to side bowing and other movements, and maintains the structural rigidity (best strength to weight ratio) of struts 34, and therefore of umbrella 10 in the open configuration. The coring of struts 34 need not be in the form of the lengthwise channels shown, but may take any other suitable configuration, such as circular holes or recesses, a honeycomb cored configuration or the like, or any combination thereof, in the struts. Also, the coring may be in the form of recessed sections or through holes.

The proximal end 34a of each strut 34 is provided with a through hole 38 through which a pivot pin 40 extends. The opposite ends of each pivot pin 40 are fit in pin openings 32 of opposing side walls 28 of a respective pair of adjacent wedge-shaped strut retainers 26, so as to pivotally secure each strut 34 in a rectangular-shaped slot 30 of hub 20. However, other pivoting arrangements such as living hinges, ball detect pivoting arrangements, and the like can be used. Thus, each strut 34 can be pivoted to the open position of FIGS. 6–8 in which it is substantially perpendicular to central axis 25 and to the closed, stored position of FIGS. 3–5 in which it is substantially parallel to central axis 25. In the stored position, all of the struts 34 can slide within tubular handle 12. In addition, it is possible to mold the struts into a slightly prebowed configuration.

An elongated rod 42 having a length greater than the length of tubular handle 12, has a threaded upper end 42a that extends through central bore 24 of hub 20. A stop nut 44 or the like is fixed to rod 42 immediately below threaded upper end 42a in order to limit the extent that elongated rod 42 extends through central bore 24. Alternatively, threaded upper end 42a end stop nut 44 can be eliminated, and in place thereof, elongated rod 42 can be secured directly with or molded as part of hub 20.

A retainer cap 46 is attached to upper end 42a of elongated rod 42 in order to retain hub 20 and struts 34 thereat. As shown in FIGS. 4 and 9–11, retainer cap 46 includes a disc-shaped base 48 and a semi-circular turning wall 50 mounted on the upper surface of base 48 along a diameter thereof. Turning wall 50 has opposite circular indentations 52 for easy grasping between the fingers of a hand of a person. In addition, a lower reinforcement wall 54 is provided to reinforce the connection between turning wall 50 and base 48. It will be appreciated that retaining cap 46 prevents pivotal movement of struts 34 upwardly to an inverted position.

Figure 7:
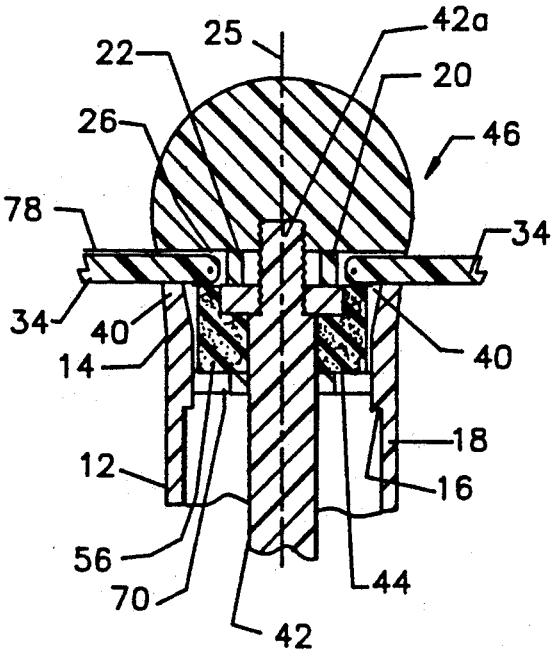
FIG. 7 is an enlarged longitudinal cross-sectional view of the upper portion of the umbrella of FIG. 6.

As shown in FIGS. 4 and 7, an annular resilient member 56 made of foam rubber or other resilient material, is provided in surrounding relation to elongated rod 42 immediately below threaded upper end 42a thereof and in surrounding relation to stop nut 44. Resilient member 56 functions to bias struts 34 outwardly. In this regard, when struts 34 are disposed within tubular handle 12, resilient member 56 is slightly compressed. When struts 34 are removed from tubular handle, resilient member 56 biases struts 34 outwardly by a small amount, the reason for which will become apparent from the description hereinafter.

Figure 8:
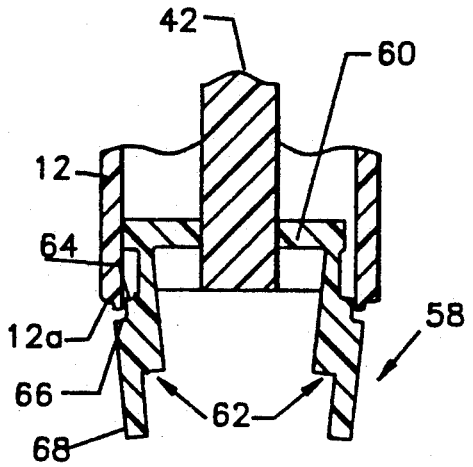
FIG. 8 is an enlarged longitudinal cross-sectional view of the lower portion of the umbrella of FIG. 6.
Figure 12:
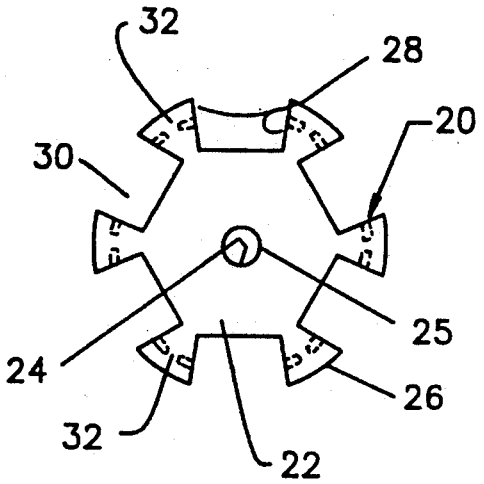
FIG. 12 is a top plan view of the hub.
Figure 9:
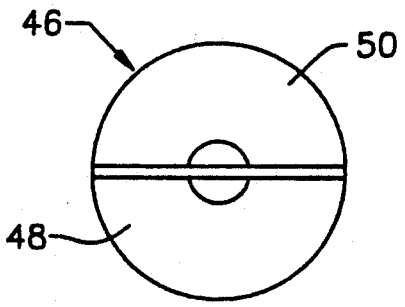
FIG. 9 is a top plan view of the retainer cap.
Figure 13:
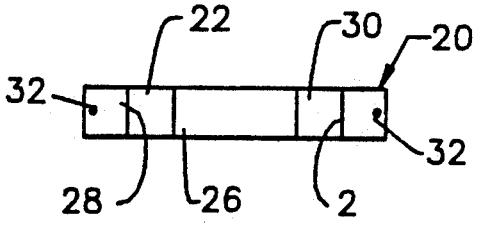
FIG. 13 is a side elevational view of the hub.
Figure 10:
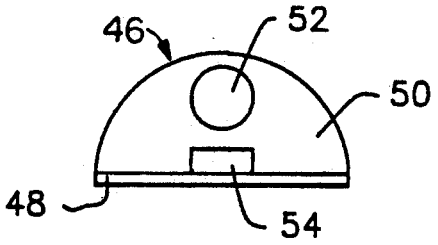
FIG. 10 is a side elevational view of the retainer cap.

As shown best in FIGS. 5 and 8, a lower retainer 58 is fixed to the lower end of elongated rod 42. Lower retainer 58 functions to lock umbrella in either the open configuration or the closed configuration. Lower retainer 58 includes a main hub 60 secured to the lower end of elongated rod 42, and two spring fingers 62 secured to opposite sides of main hub 60 in diametrically opposite relation to each other. Each spring finger 62 is rounded to conform to the circular lower edge 12a of tubular handle 12.

Each spring finger 62 includes an upper step 64 at the outer surface thereof and a lower step 66 at the outer surface thereof. Lower step 66 is positioned outwardly in the radial direction from upper step 64 and below upper step 64. An engaging member 68 is formed at the lower portion of each spring finger 62 by which a user can bias spring fingers 62 inwardly toward each other.

Figure 14:
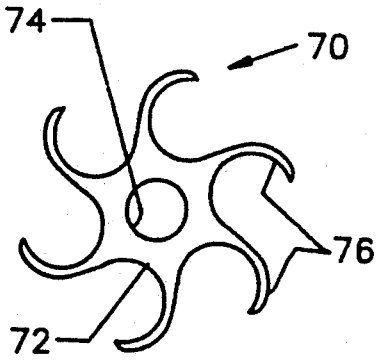
FIG. 14 is a top plan view of the star wheel.
Figure 11:
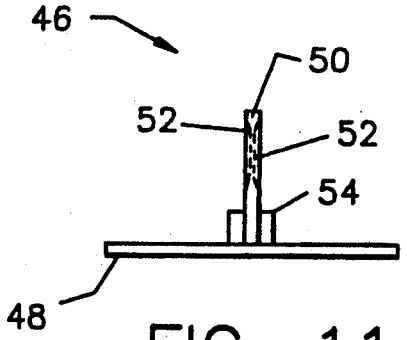
FIG. 11 is a side elevational view of the retainer cap, viewed from a direction 90° offset from the view of FIG. 10.
Figure 15:
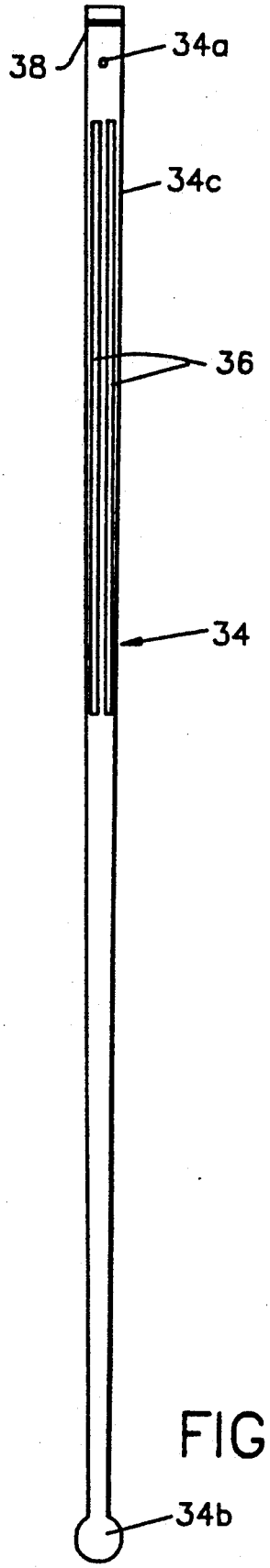
FIG. 15 is a top plan view of one strut.
Figure 16:
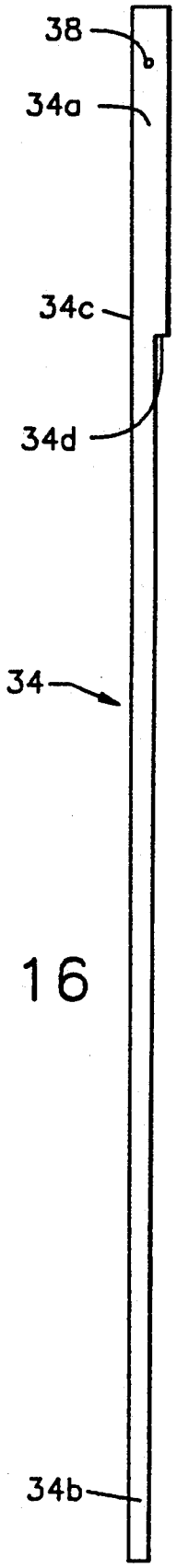
FIG. 16 is a side elevational view of one strut.
Figure 14A:
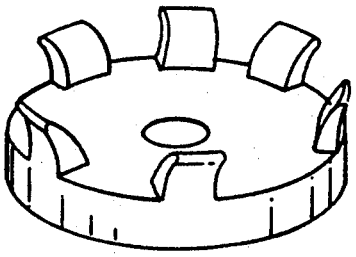
FIG. 14A is a perspective view of a star wheel according to an alternative embodiment.

Umbrella 10 further includes a star wheel 70 having an annular section 72, as shown in FIGS. 5, 7 and 14. A central bore 74 having a central axis 75 is provided in annular section 72. In this manner, star wheel 70 is provided in surrounding relation to elongated rod 42 so as to slide thereon. A plurality of resilient spiral arms 76 extend outwardly in the radial direction from central annular section 72 and are equiangularly spaced thereabout. Preferably, there are six spiral arms 76, although the present invention is not limited thereby. The outer diameter of star wheel 70, as defined by the outer peripheries of spiral arms 76, is slightly more than the inner diameter of tubular handle 12 so that star wheel 70 can freely slide therein with spiral arms 76 controlling the friction against the inner surface of tubular handle 12. As will be appreciated from the discussion hereinafter, star wheel 70 functions as a guide for elongated rod during the opening and closing of umbrella 10. An alternative embodiment of a star wheel is shown by star wheel 70 in FIG. 14A, which has arms 76 that are more durable against breakage.

As shown in FIGS. 1 and 17–19, umbrella 10 includes a canopy 78 for providing the necessary protection against rain and other elements. Canopy 78 is shown with a hexagonal configuration, although the present invention is not limited thereby. Thus, canopy 78 can be formed with any other suitable configuration, such as a circular, square, pentagonal, octagonal and the like configuration.

Canopy 78 is formed from a single flat sheet 80 of web material. The web material is of the type conventionally used in umbrella canopies and is therefore water-resistant. Further, the web material should have a degree of elasticity in order that canopy 78 retains its original shape when stretched and released.

Single sheet 80 of canopy 78 is initially formed in a flat, substantially hexagonal configuration with six integrally formed, identical sectors 82a–82f. In order to better show such sectors 82a–82f, radially oriented imaginary lines 86a–86g are provided which divide single sheet 80 into sectors 82a–82f, with each imaginary line 86a–86g extending from the center of canopy 78 to the periphery thereof. Since sheet 80 is made as a single sheet, it is emphasized that lines 86a–86g are only imaginary and are used only for explanatory purposes. The length $\alpha$ of each imaginary line 86a–86g is greater than the length B of the periphery of each sector, that is $\alpha > \beta$.

An additional tuck sector 88 is formed between the first sector 82a and the last sector 82g, that is, between imaginary lines 86a and 86g. Although tuck section 88 is shown to have a central sector angle of approximately 7°, the present invention is not limited thereby.

It will be appreciated that single sheet 80 is flat with no bowed configuration, and can therefore be easily cut or stamped from a larger sheet of material. In order to impart a bowed configuration thereto, the web material of sheet 80 of tuck sector 88 is pinched together. Specifically, the web material is pinched together such that imaginary lines 86a and 86g become substantially coincident. Then, the web material is secured thereat to retain imaginary lines 86a and 86g in such coincident configuration. Preferably, such securement is accomplished by a heat or ultrasonic sealing, although other means may be provided for retaining imaginary lines 86a and 86g in such coincident configuration, for example, sewing, tacking, adhesion or other securement means. Accordingly, a tuck 90 is formed by the web material within tuck sector 88, as shown in FIG. 18.

Figure 18:
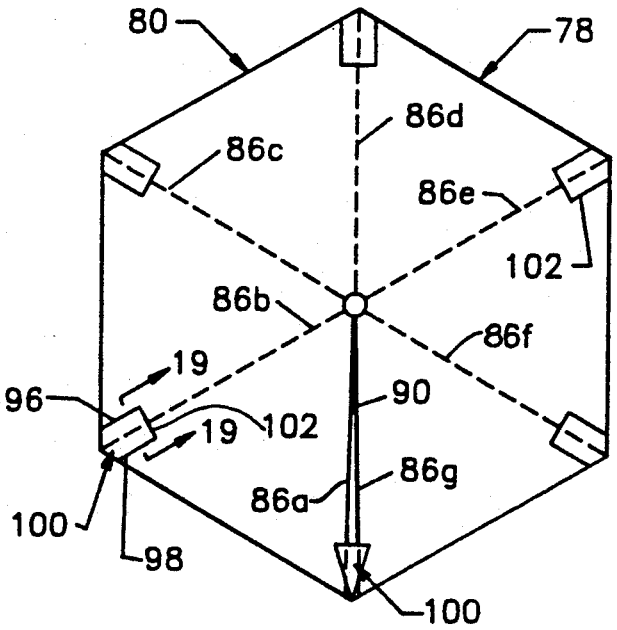
FIG. 18 is a bottom plan view of the umbrella canopy of FIG. 1 formed from the single sheet of web material of FIG. 17.
Figure 20:
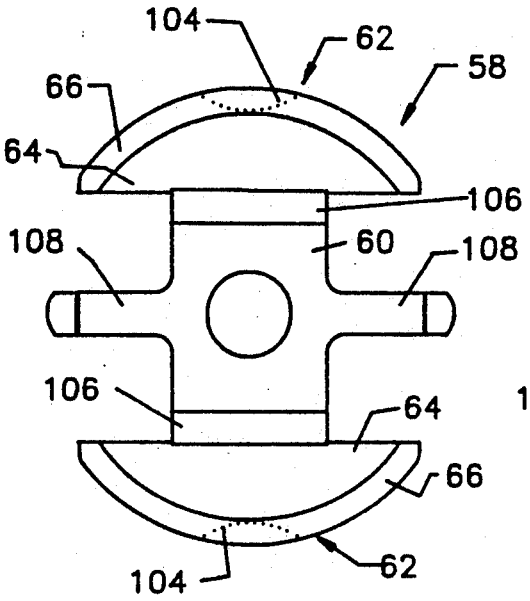
FIG. 20 is a top plan view of a modified lower retainer according to the present invention.
Figure 21:
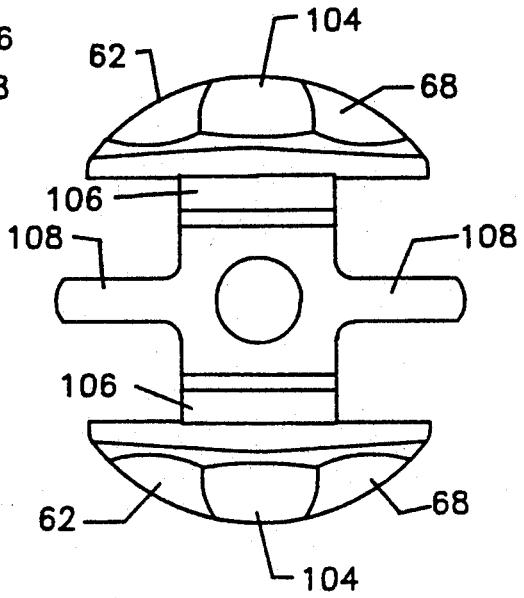
FIG. 21 is a bottom plan view of the lower retainer of FIG. 20.
Figure 22:
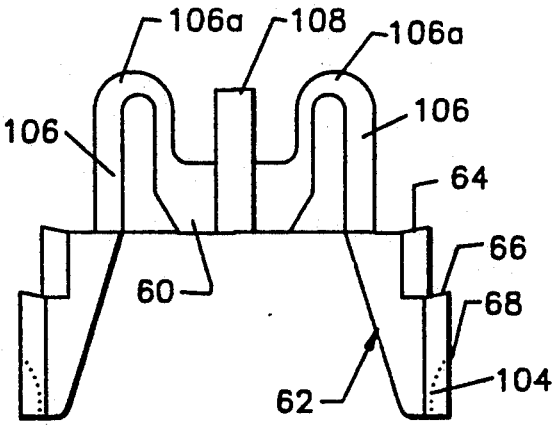
FIG. 22 is a side elevational view of the lower retainer of FIG. 20.
Figure 23:
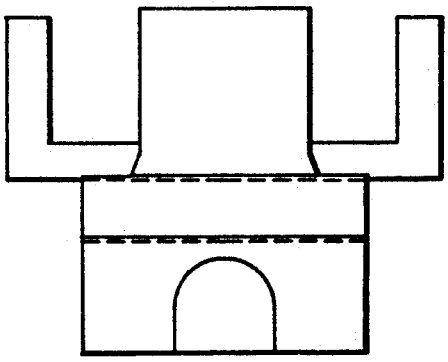
FIG. 23 is a side elevational view of the lower retainer of FIG. 22, viewed from a direction 90° offset from the view of FIG. 22.

In this configuration of FIG. 18, a circumferential force is applied to canopy 78, thereby forcing canopy 78 into the bowed configuration of FIG. 1. The amount of bowing or convexity of canopy 78 will depend on the size of tuck sector 88, that is, the larger the central angle of tuck section 88, the larger the convexity of canopy 78.

It will be appreciated that, while the central angle of each sector 82a–82f is slightly less than 60° prior to the formation of tuck 90, the central angle of each sector 82a–82f is equal to 60° after the tuck 90 is formed, due to the elimination of tuck sector 88.

In addition, a small central opening 92 is provided in canopy 78 in order to secure canopy 78 to the upper end of elongated rod 42. Specifically, central opening 92 fits over threaded upper end 42a of elongated rod 42 and is sandwiched between hub 20 and retainer cap 46.

It will be appreciated that, although one tuck section 88 has been shown, more than one tuck section 88 may be provided. For example, three tuck sections 88, six tuck sections 88 or the like can be provided between various different imaginary lines 86. In such case, a single machine can be utilized to simultaneously grip and pinch together the multiple tuck sections 88. With more tuck sections 88 being provided, a more even force is applied to sheet material 80 in the bowed configuration.

Although tuck section 88 has been shown to extend from central opening 92 of single sheet 80 to the periphery thereof, this need not be the case. For example, a tuck section 88 may start at a position outwardly from central opening 92, as measured in the radial direction. In such case, the bowing effect will only be at the periphery of canopy 78 which corresponds to the tuck section or tuck sections. It is important, however, that each such tuck section 88 extend to the periphery of single sheet 80. It is also preferable that each tuck section increase in width toward the periphery of single sheet 80, preferably in a triangular, sector-shaped configuration, although it is possible to form each tuck section with a uniform width.

Although a tuck 90 has been shown to form single sheet 80 into a bowed configuration, it is possible to form a single sheet 80 into a bowed configuration in other ways, such as by providing an open area in place of each tuck section 88, and securing together opposite edges of the single sheet which define the open area.

Figure 17:
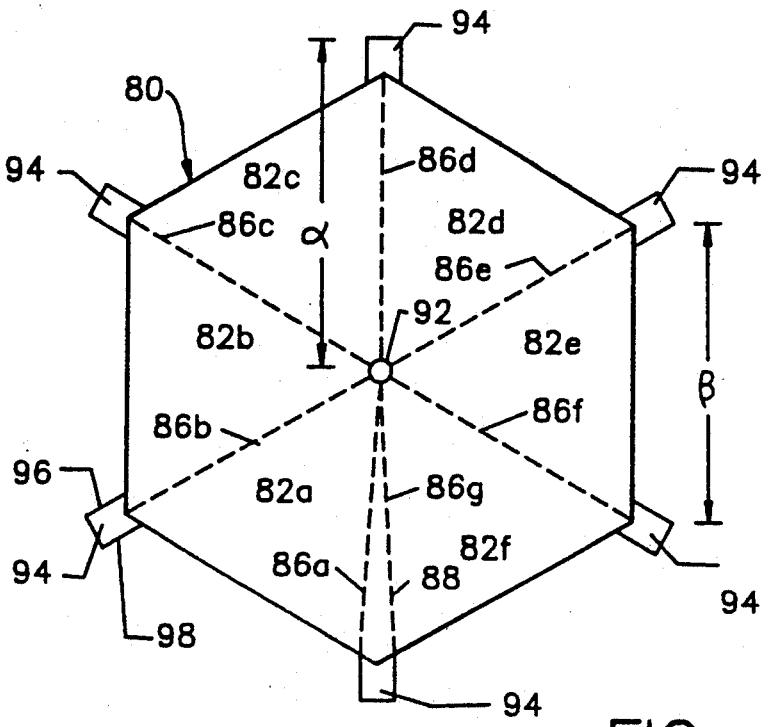
FIG. 17 is a plan view of a single sheet of web material for constructing the umbrella canopy.
Figure 19:
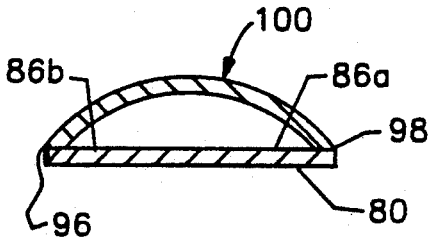
FIG. 19 is a cross-sectional view of the umbrella canopy of FIG. 18, taken along line 19—19 thereof.

Preferably, pocket flaps 94 are provided at each peripheral corner of the hexagonal single sheet 80, as shown in FIG. 17. When folded over and sealed to the bottom of single sheet 80 at opposite edges 96 and 98 thereof, as shown in FIGS. 18 and 19, a pocket 100 is formed, having an opening 102, for receiving the distal end 34b of a respective strut 34.

In order to assemble umbrella 10, stop nut 44 is assembled at the upper end of elongated rod 42 below upper threaded upper end 42a thereof and resilient member 56 is slidably positioned at the upper end of elongated rod 42 in partial surrounding relation to stop nut 44. Then, star wheel 70 is slidably inserted over the lower end of elongated rod 42, and lower retainer 58 is secured to the lower end of elongated rod 42.

Struts 34 are then pivotally connected to hub 20 by means of pivot pins 40. Upper threaded end 42a of elongated rod 42 is inserted through central bore 24 of hub 20 until stop nut 44 abuts against the underside of annular section 22 of hub 20. Then, canopy 78 is assembled therewith, such that central opening 92 fits over threaded upper end 42a of elongated rod 42 and such that the distal end 34b of each strut 34 is fit within a pocket 100 at the underside of canopy 78. Struts 34 are then pivoted downwardly to the closed configuration of FIG. 3 so that struts 34 are substantially parallel and adjacent to elongated rod 42.

Elongated rod 42 is then inserted through the lower end of tubular handle 12, threaded upper end 42a first, and pushed upwardly until upper steps 64 of spring fingers 62 abut against circular lower edge 12a of tubular handle 12. At this time, retainer cap 46 is threaded onto threaded upper end 42a of elongated rod 42 until the underside of base 48 thereof rests on upper flared end 14 of tubular handle 12. Umbrella 10 is thus in its closed, stored configuration.

In order to use umbrella 10, engaging members 68 are pressed so that spring fingers 62 are depressed inwardly by the user. At the same time, spring fingers 62 are pushed upwardly until lower steps 66 are within tubular handle 12, that is, until lower steps 66 have cleared lower edge 12a of tubular handle 12. Then, retainer cap 46 is pulled upwardly, until the distal ends 34b of struts 34 have cleared the upper open end of tubular handle 12. At this time, star wheel 70, which rests on lower retainer 58, is moved upwardly with retainer cap 46 and elongated rod 42, to a position immediately before upper flared end 14. In this position, the lower surface of star wheel 70 is higher than the lowermost edges of tabs 18. Further, because of the spring effect of spiral arms 76, star wheel 70 is held therein by friction. Accordingly, star wheel 70 functions as a stabilizer for elongated rod 42 in order to maintain elongated rod 42 in axial alignment with tubular handle 12 during the opening of umbrella 10. In order to ensure that spiral arms 76 of star wheel 70 do not prevent star wheel 70 from entering its correct position, the lower edges of stop tabs 18 are inclined.

Then, elongated rod 42 is pushed back down into tubular handle 12. During such movement, star wheel 70 is retained by friction within upper flared end 14 and guides elongated rod 42 centrally within tubular handle 12. Because resilient member 56 has biased struts 34 outwardly by a small amount, when elongated rod 42 is pushed into tubular handle 12, the distal or free ends 34b of struts 34 ride along the upper edge of upper flared end 14, and are positioned outwardly in the radial direction of handle 12. Accordingly, continued downward movement of elongated rod 42 into handle 12 results in struts 34 pivoting upwardly and outwardly to the position shown in FIGS. 1, 6 and 7, whereby struts 34 rest against the upper edge of tubular handle 12. It will be appreciated that the upper flared end 14 provides a wider support for struts 34. When struts 34 are in the position shown in FIGS. 1, 6 and 7, lower steps 66 of spring fingers 62 catch on lower edge 12*a* of tubular handle 12, as shown in FIG. 8. Accordingly, elongated rod 42 is locked in a predetermined axial position in tubular handle 12. Thus, struts 34 are sandwiched between retainer cap 46 and the upper edge of tubular handle 12 to maintain struts 34 in the radial outward position.

Because of the bowed effect of canopy 78, as aforementioned, canopy 78 applies pressure to struts 34 to force struts 34 into the same bowed configuration, whereupon the umbrella is ready for use.

In order to close umbrella to the stored configuration of FIGS. 3–5, engaging members 68 are once again pressed so that spring fingers 62 are depressed inwardly by the user. At the same time, spring fingers 62 are pushed upwardly until lower steps 66 are within tubular handle 12, that is, until lower steps 66 have cleared lower edge 12*a* of tubular handle 12. Then, retainer cap 46 is pulled upwardly, and struts 34 are pivoted downwardly. At this time, star wheel 70, which was retained by friction within upper flared end 14, again functions as a stabilizer for elongated rod 42 in order to maintain elongated rod 42 in axial alignment with tubular handle 12 during the opening of umbrella 10.

Then, canopy 78 is furled about elongated rod 42. In such furled configuration, struts 34 are substantially parallel to elongated rod 42. Elongated rod 42 is then pushed back down into tubular handle 12. It will be appreciated that upper flared end 14 makes it easier to position the distal ends 34*b* of struts 34 back into tubular handle 12. During such movement, the distal ends 34*b* of struts 34, which are connected by canopy 78, push star wheel 70 back down with elongated rod 42 into tubular handle 12 until upper steps 64 of spring fingers 62 catch on lower edge 12*a* of tubular handle 12, as shown in FIG. 5. Accordingly, elongated rod 42 is locked in a predetermined axial position in tubular handle 12.

In accordance with a modification of the umbrella 10, lower retainer 58 is preferably formed with a slightly different configuration, as shown in FIGS. 20–23. In the first place, the outer surfaces of engaging members 68 have finger indentations 104 formed therein. Further, each spring finger 62 is connected to main hub 60 by an inverted spring loop 106. More importantly, diametrically opposite L-shaped arms 10B are provided 90° offset from spring fingers 62. The upper ends of L-shaped arms 108 are substantially coplanar with the upper ends 106*a* of spring loops 106.

This embodiment of lower retainer 58 permits easier furling of canopy 78 when closing umbrella 10. Specifically, and as discussed above, during the closing operation, elongated rod 42 is forced upwardly out of tubular handle 12. However, when canopy 78 is furled or rotated about elongated rod 42, there is a tendency for elongated rod 42 to rotate within tubular handle 12 and star wheel 70. With the use of lower retainer 58 of FIGS. 20–23, when elongated rod 42 is in its uppermost position, each stop tab 18 fits within a space defined by one L-shaped arm fixed to elongated rod 42, this prevents rotation of elongated rod 42 during the furling operation.

Figure 25:
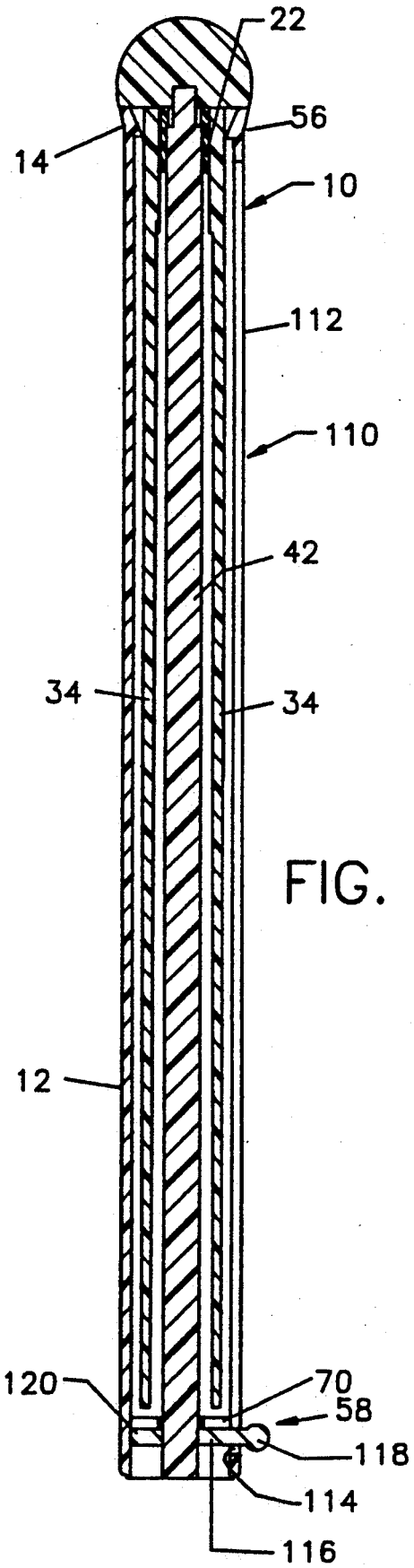
FIG. 25 is a longitudinal cross-sectional view of the umbrella of FIG. 24 in its stored position.
Figure 24:
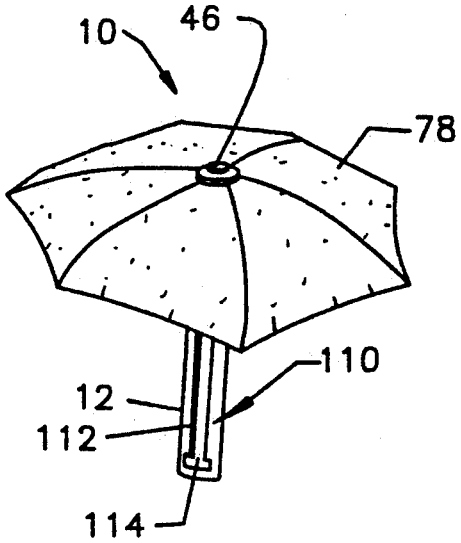
FIG. 24 is a perspective view of an umbrella according to another embodiment of the present invention.

With all of the above embodiments, it is necessary to pull on retainer cap 46 to remove elongated rod 42 from tubular handle 12. In accordance with another modification of the present invention, as shown in FIGS. 24 and 25, lower retainer 58 is eliminated. In place thereof, tubular handle 12 includes an inverted T-shaped slot 110 formed by an elongated axially extending portion 112 and a lower transverse portion 114. A pin 116 having an enlarged head 118 is fixed to the lower end of elongated rod 42 and extends through slot 110. A counterbalancing pin 120 is fixed to the diametrically opposite side of elongated rod 42. Thus, this embodiment, which is generally similar to U.S. Pat. No. 4,084,600, reduces the complexity thereof.

With this embodiment, in order to move elongated rod 42 out of tubular handle 12, the user grasps enlarged head 118 and moves pin 116 upwardly within axially extending portion 112 of slot 110. In order to lock umbrella 10 in the closed or open configuration, that is, when elongated rod 42 is positioned within tubular handle 12, pin 116 is moved into transverse portion 114 of slot 110. Although not shown, it is possible to have one side of transverse portion 114 lower than the other side to account for the closed and open configurations of umbrella 10 in which pin 116 would be positioned at slightly different heights. Alternatively, two diametrically opposite inverted T-shaped slots can be formed.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. An umbrella comprising:

a hollow tubular handle extending in an axial direction, said hollow tubular handle having an upper edge and a lower portion;

an elongated rod having an upper end and a lower end, said elongated rod movable in the axial direction within said hollow tubular handle;

a plurality of struts pivotally mounted to the upper end of said elongated rod for movement in a range between a storage position substantially parallel to said axial direction and adjacent to said elongated rod, and an open position substantially perpendicular to said axial direction;

a web of flexible, water-resistant material connected to said struts; and locking means fixed to a lower end of said elongated rod for preventing movement of said elongated rod in said axial direction when said struts are in said open position and said storage position, by engaging with a lower portion of said tubular handle to releasably lock said struts in:

said open position in which said struts are positioned substantially perpendicular to said axial direction and rest on the upper edge of said tubular handle, and said storage position in which said struts are positioned substantially parallel to said axial direction and adjacent to said elongated rod within said tubular handle.

2. An umbrella according to claim 1, wherein said hollow tubular handle includes an upper portion which is outwardly flared, and said upper portion includes said upper edge.

3. An umbrella according to claim 1 further including hub means for pivotally mounting said struts to the upper end of said elongated rod.

4. An umbrella according to claim 3, wherein said hub means includes an annular section having a central bore for receiving the upper end of said elongated rod and a plurality of strut retaining walls extending radially outward from said annular section so as to define strut receiving slots therebetween; and further including pivot pin means extending between adjacent strut retaining walls for pivotally connecting said struts to said hub means.

5. An umbrella according to claim 4, wherein said strut retaining walls have a substantially wedge shape.

6. An umbrella according to claim 4, further including stop means on said elongated rod for positioning said hub means thereon at a predetermined position.

7. An umbrella according .to claim 6, further including retaining means secured to the upper end of said elongated rod for maintaining said hub means thereon.

8. An umbrella according to claim 7, wherein said web includes a central opening for receiving the upper end of said elongated rod, and said web is sandwiched between said hub means and said retaining means.

9. An umbrella according to claim 3, further including resilient means for biasing said struts in a radially outward direction.

10. An umbrella according to claim 9, wherein said resilient means is positioned about said elongated rod immediately below said hub means.

11. An umbrella according to claim 1, further including retaining means secured to the upper end of said elongated rod for restricting pivoting movement of said struts outside of said range.

12. An umbrella according to claim 11, wherein said retaining means includes a retaining cap connected to the upper end of said elongated rod.

13. An umbrella according to claim 1, wherein said locking means includes at least one spring finger mounted to the lower end of said elongated rod, each said spring finger having a first releasable lock means for engaging with the lower portion of said tubular handle to releasably lock said struts in said open position in which said struts are positioned substantially perpendicular to said axial direction and rest on the upper edge of said tubular handle, and a second releasable lock means for engaging with the lower portion of said tubular handle to releasably lock said struts in said storage position in which said struts are positioned substantially parallel to said axial direction and adjacent to said elongated rod within said tubular handle.

14. An umbrella according to claim 13, wherein said first releasable lock means of each said spring finger includes a first outer step in the respective spring finger, and said second releasable lock means of each said spring finger includes a second outer step in the respective spring finger.

15. An umbrella according to claim 14, wherein said first outer step is positioned below said second outer step on each respective spring finger.

16. An umbrella according to claim 15, wherein said first outer step is positioned radially outward of said second outer step on each respective spring finger.

17. An umbrella according to claim 13, wherein there are two said spring fingers which are diametrically opposite each other for engaging opposite sides of the lower portion of the tubular handle.

18. An umbrella according to claim 13, wherein said tubular handle has an upper portion containing said upper edge, said upper portion having an inner surface with at least one stop tab thereon, and each said locking means further includes at least one restraining arm means for cooperating with said at least one spring finger to receive said at least one stop tab therebetween so as to prevent rotation of said elongated rod in said tubular handle when furling said web during a closing operation of said umbrella.

19. An umbrella according to claim 1, wherein said locking means includes:

a substantially T-shaped slot in said tubular handle, said substantially T-shaped slot including an axial portion which extends axially along said tubular handle and a transverse portion which extends substantially perpendicular to said axial portion and is in communication with a lower end of said axial portion; and pin means connected with the lower end of said elongated rod and extending through said slot for:

moving said elongated rod axially within said tubular handle when said pin means is engaged in said axial portion, and preventing movement of said elongated rod and releasably locking said struts in said open and storage positions when said pin means is engaged within said transverse portion.

20. An umbrella according to claim 1, further including guide means for maintaining said elongated rod in a coaxial relation with said tubular handle when said elongated rod is moved in the axial direction of said tubular handle.

21. An umbrella according to claim 20, wherein said guide means includes star wheel means having an annular section rotatably and slidably mounted on said elongated rod, and a plurality of spring arm means extending radially outward from said annular section for engaging with an inner surface of said tubular handle, to maintain the elongated rod in a central location when opening said umbrella.

* * * * *